US008939673B2

(12) United States Patent
Walz

(10) Patent No.: US 8,939,673 B2
(45) Date of Patent: Jan. 27, 2015

(54) SHELF CARRIER AND SHELF ARRANGEMENT

(75) Inventor: Rüdiger Walz, Haigerloch (DE)

(73) Assignee: Häfele GmbH & Co. KG, Nagold (DE)

( * ) Notice: Subject to any disclaimer, the term of this patent is extended or adjusted under 35 U.S.C. 154(b) by 543 days.

(21) Appl. No.: 13/387,808

(22) PCT Filed: Jun. 17, 2010

(86) PCT No.: PCT/DE2010/050037

§ 371 (c)(1),
(2), (4) Date: Jan. 30, 2012

(87) PCT Pub. No.: WO2011/012122

PCT Pub. Date: Feb. 3, 2011

(65) Prior Publication Data

US 2012/0125873 A1 May 24, 2012

(30) Foreign Application Priority Data

Jul. 28, 2009 (DE) ..... 20 2009 010 237 U

(51) Int. Cl.
*B25G 3/00* (2006.01)
*A47B 96/06* (2006.01)

(52) U.S. Cl.
CPC ..... *A47B 96/066* (2013.01); *Y10S 403/12* (2013.01); *Y10S 403/11* (2013.01)
USPC ..... 403/245; 403/DIG. 12; 403/DIG. 11; 248/250

(58) Field of Classification Search
CPC ..... A47B 96/066; F16B 12/2054; F16B 2012/2018
USPC ..... 248/250, 225.11; 312/264; 211/134; 403/231, DIG. 12, DIG. 11, 245
See application file for complete search history.

(56) References Cited

U.S. PATENT DOCUMENTS

| | | | | |
|---|---|---|---|---|
| 3,580,535 | A * | 5/1971 | Naske | 248/239 |
| 4,099,293 | A * | 7/1978 | Pittasch | 16/245 |
| 4,353,663 | A | 10/1982 | Glickman | |
| 4,357,119 | A * | 11/1982 | Pollitt | 403/231 |
| 4,599,011 | A * | 7/1986 | Tashiro et al. | 403/245 |
| 6,334,732 | B1 * | 1/2002 | Strassle et al. | 403/321 |

(Continued)

FOREIGN PATENT DOCUMENTS

EP 2177129 4/2010

*Primary Examiner* — Terrell McKinnon
*Assistant Examiner* — Daniel Breslin
(74) *Attorney, Agent, or Firm* — Lucas & Mercanti, LLP; Klaus P. Stoffel

(57) ABSTRACT

A shelf carrier having an insertion pot with a T-shaped suspension opening on a side wall, the suspension opening being formed by a longitudinal slit extending parallel to the pot axis and by a transverse slit extending perpendicularly thereto. The longitudinal slit is open at an end facing away from the transverse slit. A slider is supported in the insertion pot so as to be displaceable transversely to the longitudinal slit. A longitudinal slit is formed on the slider, which extends parallel to the longitudinal slit of the insertion pot and is open at an end facing away from the insertion pot transverse slit, and forms a common insertion slit together with the insertion pot longitudinal slit in a center position of the slider. The slider is lockable with the insertion pot in the center position and/or in end positions transversely shifted to both sides of the center position.

12 Claims, 7 Drawing Sheets

(56) References Cited

U.S. PATENT DOCUMENTS 6,848,855 B2 * 2/2005 Hasler ..... 403/409.1
6,939,075 B2 * 9/2005 Walz ..... 403/231
7,413,367 B2 * 8/2008 Hawang ..... 403/297
7,578,633 B2 * 8/2009 Walz ..... 403/350

* cited by examiner

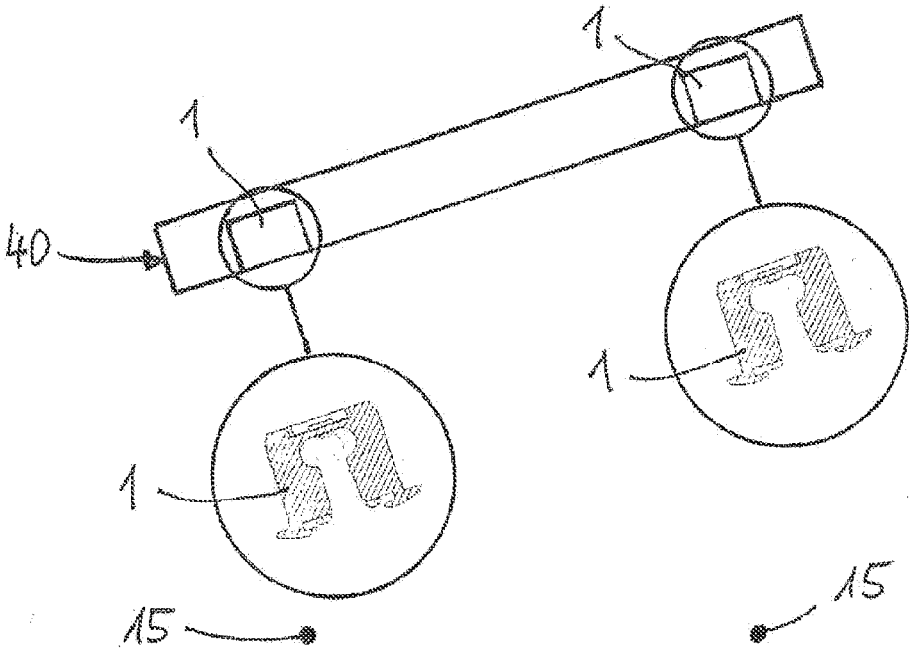
Fig. 12a
Fig. 12b
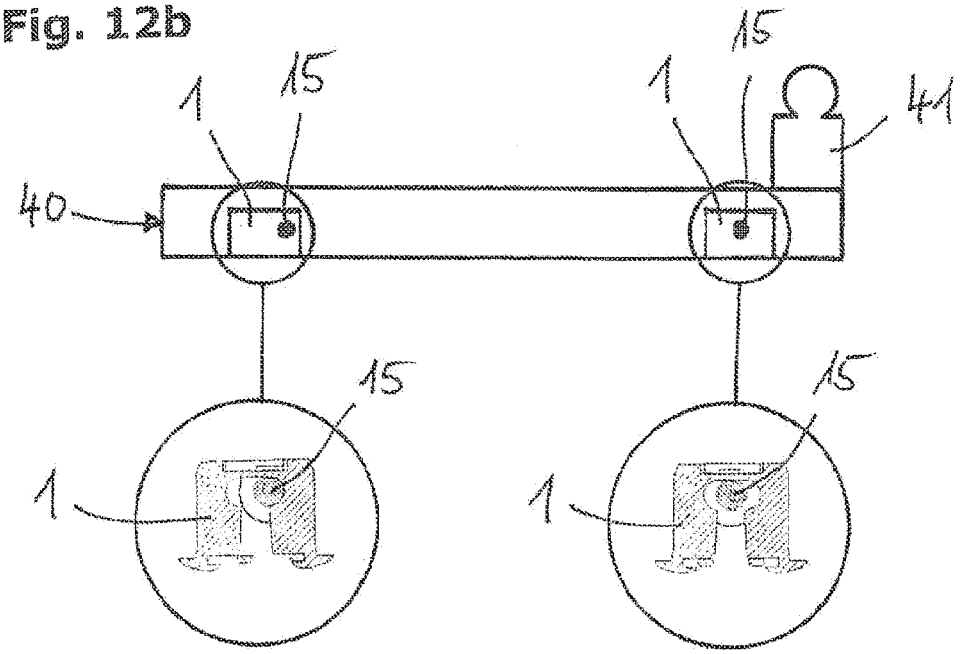

SHELF CARRIER AND SHELF ARRANGEMENT

The present application is a 371 of International application PCT/DE2010/050037, filed Jun. 17, 2010, which claims priority of DE 20 2009 010 237.8, filed Jul. 28, 2009, the priority of these applications is hereby claimed and these applications are incorporated herein by reference.

BACKGROUND OF THE INVENTION

The invention relates to a shelf carrier comprising an insertion pot, which has a T-shaped suspension opening on a side wall, the T-shaped suspension opening being formed by a longitudinal slit extending parallel to the pot axis and by a transverse slit extending perpendicularly thereto, the longitudinal slit being open at the end thereof facing away from the transverse slit, and to a shelf arrangement comprising a shelf, the shelf having a shelf carrier on both sides of each shelf end.

Shelf carriers of this type are used for suspending shelves, such as e.g. shelves for bookcases, between two side walls of a bookcase. Towards this end, four shelf carriers are inserted into corresponding receptacles on the lower side of the shelves and the shelf carriers of the shelf are subsequently suspended on pins or bolts of the side walls of the bookcase.

Prior art firstly discloses simple shelf carriers with suspension slits which are open on one side and are inserted on both sides into the lower side of the shelf at the front and rear shelf ends. However, this simple shelf carrier is disadvantageous in that, when the front shelf end is subjected to a relatively high load, the rear shelf carrier and therefore the rear shelf end might be lifted off from the associated rear mounting bolt with the consequence that the shelf is tilted.

In order to prevent tilting of the suspended shelf, it is known in the art to use different shelf carriers for the front and rear shelf ends. While the two front shelf carriers (i.e. the shelf carriers disposed most proximate to a bookcase rear wall) still have only a suspension slit that is open on one side for receiving the bolt heads, the two rear shelf carriers (i.e. the shelf carriers that are most proximate to the visible shelf front edge) have a T-shaped suspension opening which is formed by the suspension slit (longitudinal slit) that is open on one side, and by a transverse slit extending to both sides relative thereto. The shelf is initially suspended with its rear shelf carriers, to be more precise, with its longitudinal slits, in the rear mounting bolts and is subsequently shifted to the back, with the consequence that the rear mounting bolt is then in the transverse slit and the rear shelf carrier is secured on the rear mounting bolt in a direction opposite to the suspension direction. The rear mounting bolt forms the axis of rotation about which the shelf is then pivoted with its front shelf end until the longitudinal slit of the front shelf carrier is suspended in the front mounting bolt. The rear shelf carrier that is secured in a direction opposite to the suspension direction ensures that the suspended shelf is mounted in such a fashion that it cannot tilt. However, different front and rear shelf carriers have the following disadvantages:

During insertion of the shelf carriers, one must always make sure that the rear shelf carriers are inserted into the recesses of the shelf at the rear shelf end and the front shelf carriers are inserted into the recesses of the shelf at the front shelf end. Otherwise, the shelf either cannot be suspended or can be shifted forwards and backwards in the suspended state. Removal of incorrectly inserted shelf carriers accompanied by re-insertion is demanding, time-consuming and inconvenient.

The production or manufacture of two different shelf carriers and supervision to make sure that always the correct pairs of front and rear shelf carriers are provided with each delivered unit are also time-consuming and expensive.

SUMMARY OF THE INVENTION

In contrast thereto, it is the underlying purpose of the present invention to further develop a shelf carrier of the above-mentioned type in such a fashion that it can be used both as a front dud rear shelf carrier, thereby nevertheless reliably preventing tilting or displacement of a suspended shelf.

This object is achieved in that a slider is supported in the insertion pot in such a fashion that it can be displaced in a direction transverse to the longitudinal slit, wherein a longitudinal slit is formed on the slider, which extends parallel to the longitudinal slit of the insertion pot and is open at its end facing away from the transverse slit of the insertion pot, and forms, in a center position of the slider, a common insertion slit together with the longitudinal slit of the insertion pot, and that the slider can be locked with the insertion pot in the center position and/or in end positions transversely shifted to both sides of the center position.

When the slider of the inventive shelf carrier is in its center position, the shelf carrier only comprises the common longitudinal insertion slit and its function therefore corresponds to the above-described front shelf carrier according to the prior art. When its slider is in its tranversely shifted end position, the inventive shelf carrier has a T-shaped suspension opening and its function therefore corresponds to the above-described rear shelf carrier according to prior art. The inventive shelf carrier can therefore electively be used as a front or a rear shelf carrier in dependence on the position of its slider.

For mounting a shelf using inventive shelf carriers, four inventive shelf carriers are inserted into the receptacles provided for this purpose on the lower side of the shelf, wherein the sliders of all shelf carriers are located in their center positions. The two rear shelf carriers are then at first suspended with their common longitudinal insertion slit into the projecting rear bolts. The shelf is then pushed to the rear until each rear bolt is located at the front end of the transverse slit, thereby locking the two rear shelf carriers to the rear bolts in a direction opposite to the suspension direction. The two front shelf carriers are suspended with their common longitudinal insertion slit in the front bolts through a pivoting motion of the shelf about the rear bolts, such that the shelf is then in its horizontal end position. In this end position, the sliders of the front shelf carriers are in the center position and the sliders of the rear shelf carriers are in the transversely shifted or locked end position. The rear shelf carriers that are locked on the rear bolts by means of their sliders thereby prevent the shelf from being lifted off from the rear bolt and therefore from tilting.

In a preferred embodiment of the invention, the longitudinal slit of the slider terminates in a circular opening at the level of the transverse slit of the insertion pot, which opening is used, in particular, for play-free reception of a mounting bolt. The longitudinal slit of the slider advantageously has a detent on both sides at the transition to the circular opening for locking the received mounting bolt in the circular opening.

The longitudinal slit of the slider preferably tapers from its open end towards its other end to thereby form an insertion cone for the mounting bolt.

In a further preferred embodiment, the insertion pot and the slider have detents and locking seats for mutual locking in the center position and/or in the transversely shifted end position.

The detents and locking seats can also be used as guides during insertion of the slider into the insertion pot.

The insertion pot preferably has circumferential ribs on its jacket side, which are pressed into the bore wall of the shelves like retaining barbs when the shelves are made from wood, thereby reliably fixing the insertion pot in the shelf. Alternatively or additionally, the insertion pot can have detent springs, e.g. in the area of the pot bottom, which project in a radial outware direction and are locked in corresponding slits or openings of the shelf, e.g. when the shelves are made from sheet metal, thereby also fixing the insertion pot in the shelf.

The slider is advantageously undetachably held in the insertion pot, for which reason the shelf carrier can be delivered in the form of a finished unit, thereby preventing individual parts from getting lost due to unskilled handling. When the slider is inserted into the insertion pot, the slider can e.g. be locked on the insertion pot.

In one particularly preferred embodiment, the insertion pot and the slider are produced together in one work step as one unit having one or more predetermined breaking points. For this reason, it is e.g. possible to initially produce the slider and the insertion pot in one piece in the form of an injection-molded part (connected via the predetermined breaking points). This embodiment enables inexpensive production of the inventive shelf carrier. The mentioned one or several predetermined breaking points are then destroyed by pressing the slider into the pot opening of the insertion pot such that the slider can be easily inserted into the insertion pot.

The insertion pot and the slider are advantageously produced from plastic material through injection molding. either in the form of two separate parts or in the form of injection-molded parts that are still connected via predetermined breaking points.

The invention also concerns a shelf arrangement comprising a shelf, the shelf having a shelf carrier as described above on both sides of each shelf end, and also comprising four mounting bolts in which the four shelf carriers of the shelf are suspended, wherein the sliders of the shelf carriers provided at one shelf end are located in the center position and the sliders of the shelf carriers provided at the other shelf end are located in their end positions transversely shifted towards the other shelf carriers, in which end positions the shelf carrier is locked on its mounting bolt in a direction opposite to the suspension direction.

Further advantages of the invention can be extracted from the description and the drawing. The features mentioned above and below may be used in accordance with the invention individually or collectively in arbitrary combination. The embodiments shown and described are not to be understood as exhaustive enumeration but have exemplary character for describing the invention.

The invention is illustrated in the drawings and is explained in more detail with reference to embodiments.

BRIEF DESCRIPTION OF THE DRAWING

In the drawings:

FIG. 12*a* shows a schematic side view of a shelf provided with the inventive shelf carriers in the non-suspended state.

FIG. 12*b* shows a schematic side view of a shelf provided with the inventive shelf carriers in the suspended state.

DETAILED DESCRIPTION OF THE INVENTION

Figure 1:
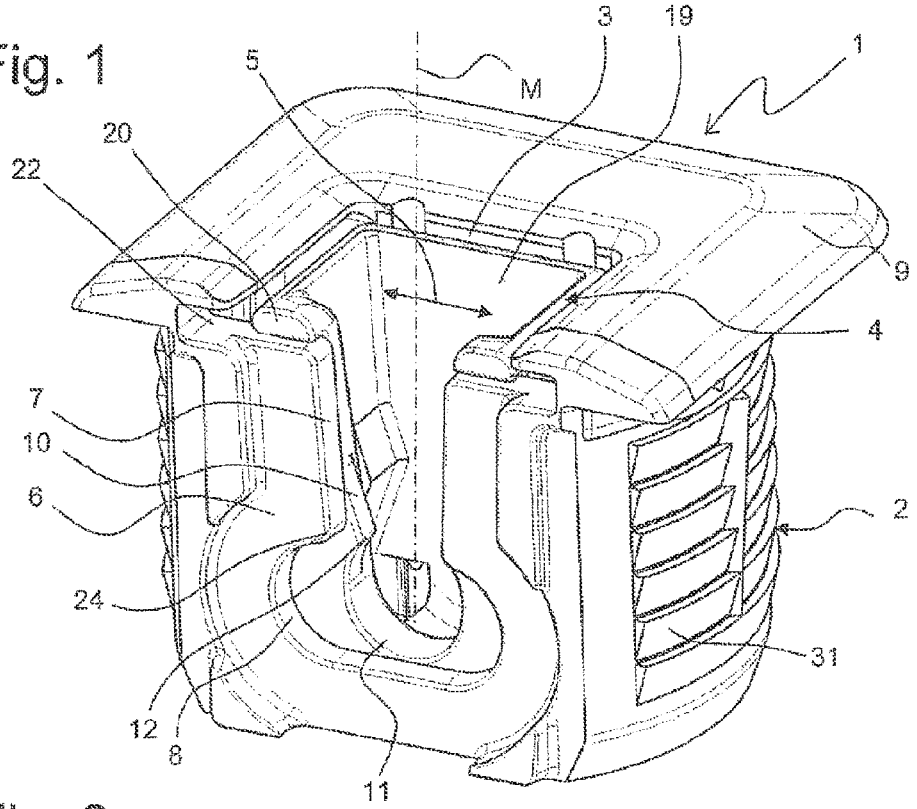
FIG. 1 shows a perspective view of the inventive shelf carrier with an insertion pot and a slider located in a center position.

The shelf carrier 1 illustrated in FIG. 1 is inserted into a bore in the bottom of a shelf and is used for suspending the shelf on a mounting bolt of a side wall of a bookcase.

The shelf carrier 1 comprises an insertion pot 2 with a pot opening 3 and a slider 4 which is inserted into the pot opening 3 and is supported therein in such a fashion that it can be displaced in a transverse direction (double arrow 5). The insertion pot 2 has a T-shaped suspension opening, illustrated upside down in FIG. 1, on a flat side wall 6 of its otherwise cylindrical circumterential surface, the suspension opening being composed of a longitudinal slit 7 extending parallel to the pot axis M and a transverse slit 8 extending perpendicularly thereto to both sides. The longitudinal slit 7 is open at its end facing away from the transverse slit 8, i.e. towards the top in FIG. 1. The transverse slit 8 is aligned in parallel with the bottom side of the insertion pot 2. The widths of the two longitudinal slits 7, 10 are identical or at least approximately identical. The upper side of the insertion pot 2 has a circumferential collar 9, except for the flat side wall 6, which collar supports the lower side of the shelf when the insertion pot 2 is inserted into the bore of the shelf. As is illustrated in FIG. 1, the slider 4 is also hollow or pot-shaped and has an approximately rectangular cross-section. The slider 4 can alternatively also be designed as a plate.

FIG. 1 shows the slider 4 in its center position, in which a longitudinal slit 10, which is open to the top, of the slider 4 forms a common insertion slit together with the longitudinal slit 7 of the insertion pot 2. The longitudinal slit 10 of the slider 4 tapers from its upper open end towards the bottom until it widens again at the level of the transverse slit 8 to form a circular opening 11. Due to the transition from the tapering to the circular opening 11, the slider 4 has a detent 12 on each of the two sides of the longitudinal slit 10. Starting from the illustrated center position, the slider 4 can be transversely shifted to both sides into an end position in each case.

Figure 2:
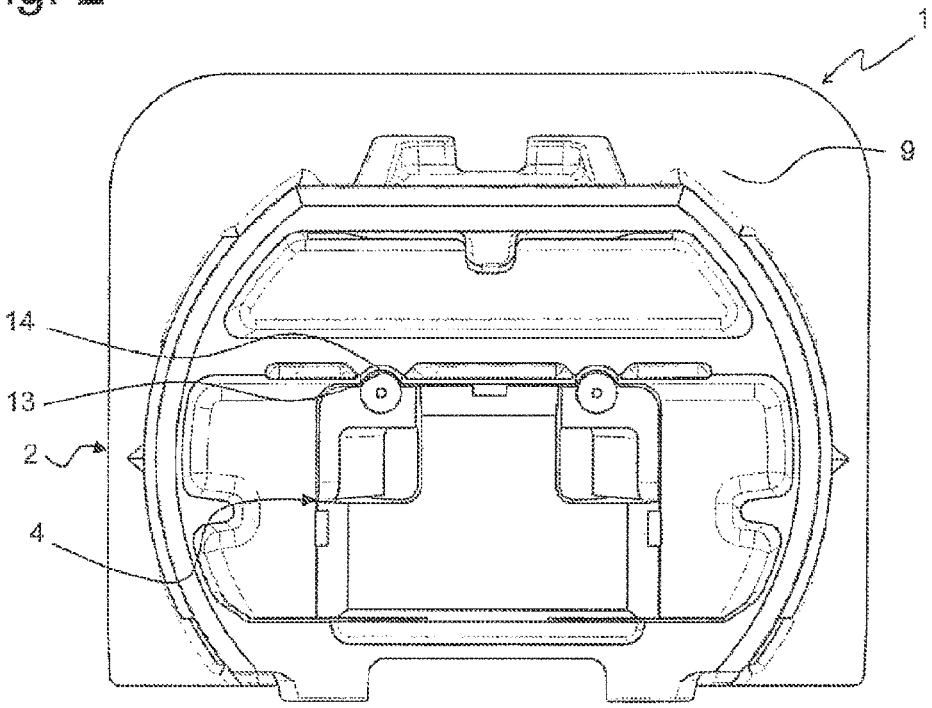
FIG. 2 shows a view from below of the shelf carrier of FIG. 1.

FIG. 2 shows that the slider 4 has two detents 13 that are spaced apart in a transverse direction 5 and are locked in the center position in two corresponding locking seats or recesses 14 of the insertion pot 2. The slider 4 can alternatively or additionally also be locked with the insertion pot 2 in its two end positions, e.g. in that the detents 13 are locked with locking recesses of the insertion pot 2 provided at that location.

Figure 3:
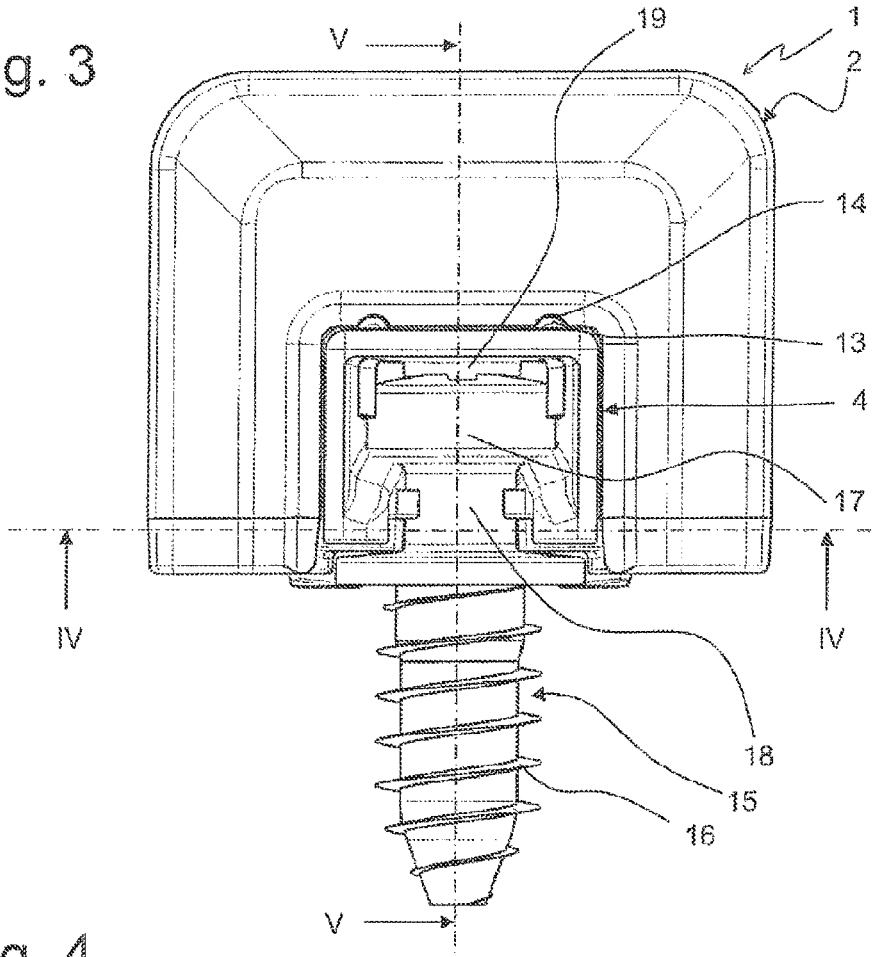
FIG. 3 shows a top view of the shelf carrier of FIG. 1, wherein a mounting bolt is inserted into the shelf carrier.
Figure 4:
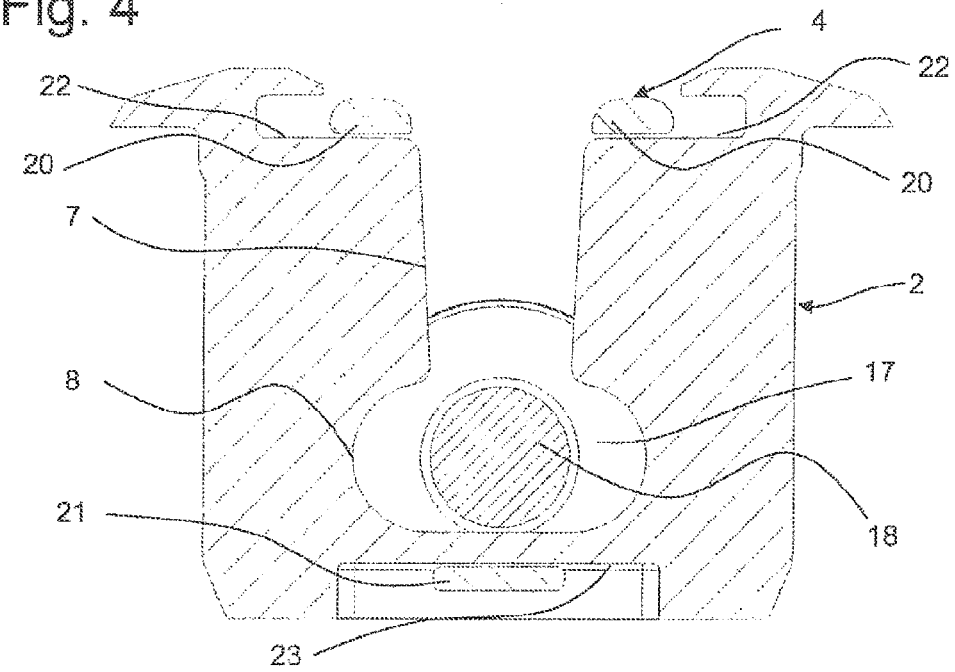
FIG. 4 shows a longitudinal section through the shelf carrier and the mounting bolt in accordance with IV-IV of FIG. 3.
Figure 5:
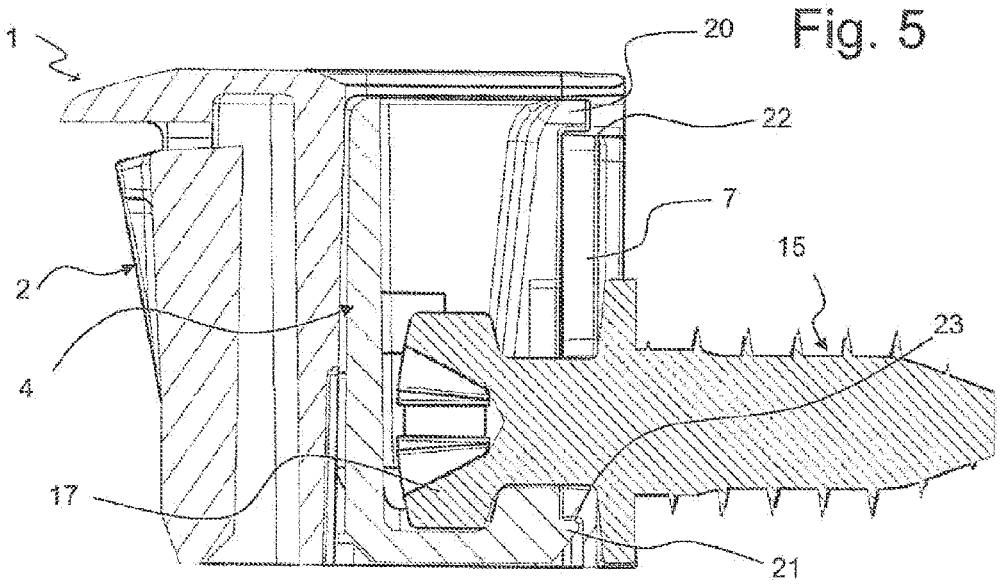
FIG. 5 shows a longitudinal section through the shelf carrier and the mounting bolt in accordance with V-V of FIG. 3.

FIGS. 3 to 5 show the shelf carrier 1 with the slider 4 located in its center position and with an inserted mounting bolt 15 which has a thread 16, a head 17 and a shaft 18 of reduced diameter therebetween. When the slider 4 is in its center position, the shaft 18 of the mounting bolt 15 is inserted into the common insertion slit of the insertion pot 2 slider 4 and is pushed further into the circular opening 11, where it is locked by detents 12, wherein at the same time the head 17 of the mounting bolt 15 is received in the aperture or pot opening 19 of the slider.

As is further illustrated in FIGS. 1 and 4, the slider 4 has two upper guiding projections 20 on its upper side and also a lower guiding projection 21 on its lower side, which Projections are transversely guided on the upper edge 22 or on a lower edge 23 of the side wall 6, thereby undetachably retaining the slider 4 in the insertion pot 2. FIG. 5 shows that the lower guiding projection 21 is formed by a notch which engages behind the lower edge 23, formed by a step, of the side wall 6 in the insertion direction of the slider 4 when the slider 4 is inserted into the insertion pot 2.

Figure 6:
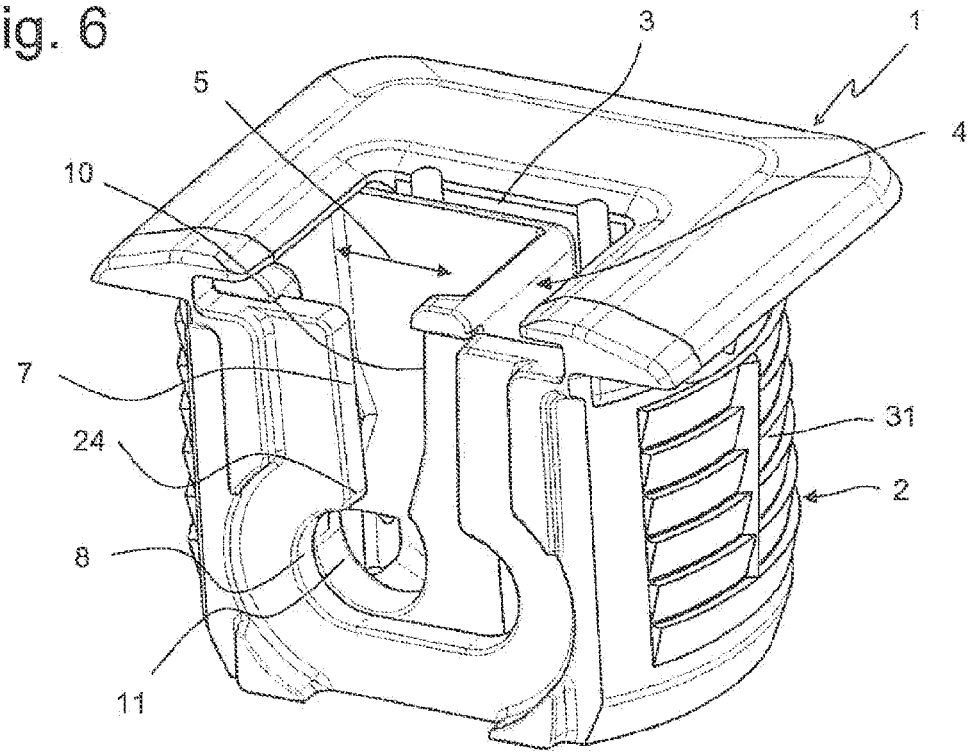
FIG. 6 shows a perspective view analogous to FIG. 1 of the shelf carrier with the slider transversely shifted into an end
Figure 7:
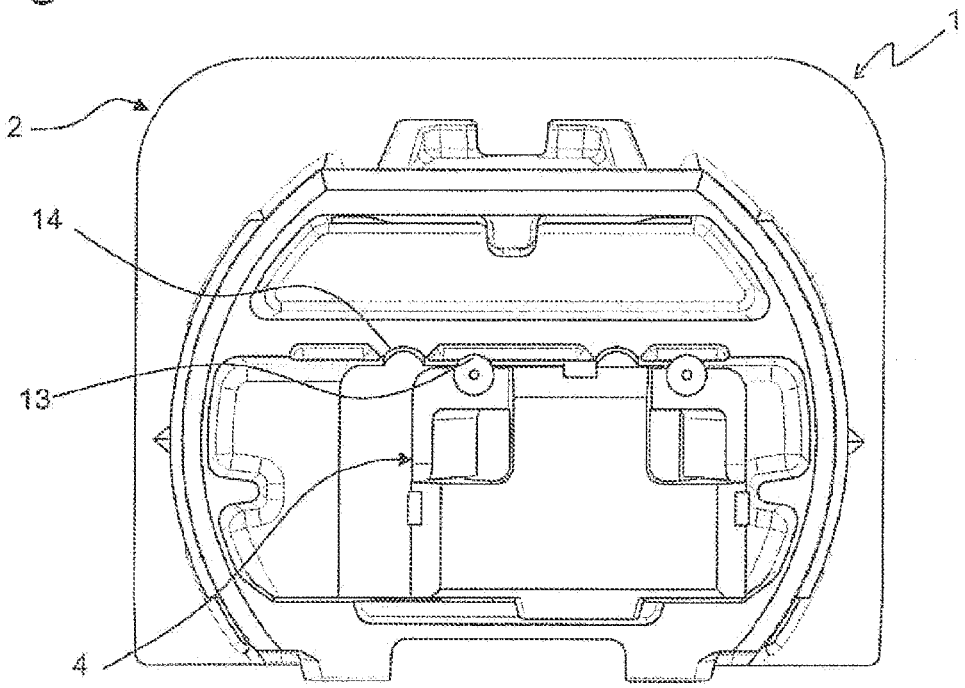
FIG. 7 shows a view from below of the shelf carrier of FIG. 6.

In FIG. 6, the slider 4 inserted into the insertion pot 2 is transversely shifted from its center position to the left into its left-hand end position, in which the circular opening 11 is located at the left-hand end of the transverse slit 8 and is covered by the edge 24 of the insertion pot 2 provided at the transition between the longitudinal and transverse slits 7, 8. In contrast to the center position illustrated in FIG. 1, the common insertion slit formed by the longitudinal slit 7 of the insertion pot 2 and the longitudinal slit 10 of the slider 4 is then considerably narrower in the transverse direction 5. As is illustrated in FIG. 7, the locking between the detents 13 and the locking recesses 14 has been released by transverse displacement of the slider 4.

Figure 8:
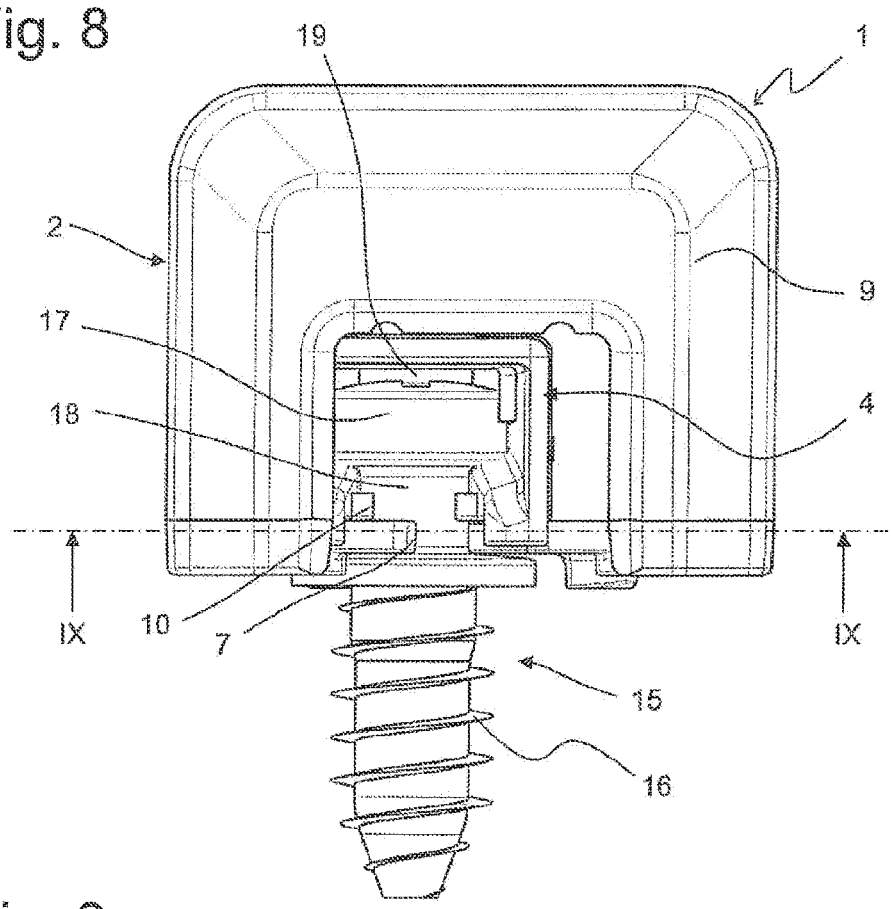
FIG. 8 shows a top view of the shelf carrier of FIG. 6, wherein a mounting bolt is inserted into the shelf carrier.
Figure 9:
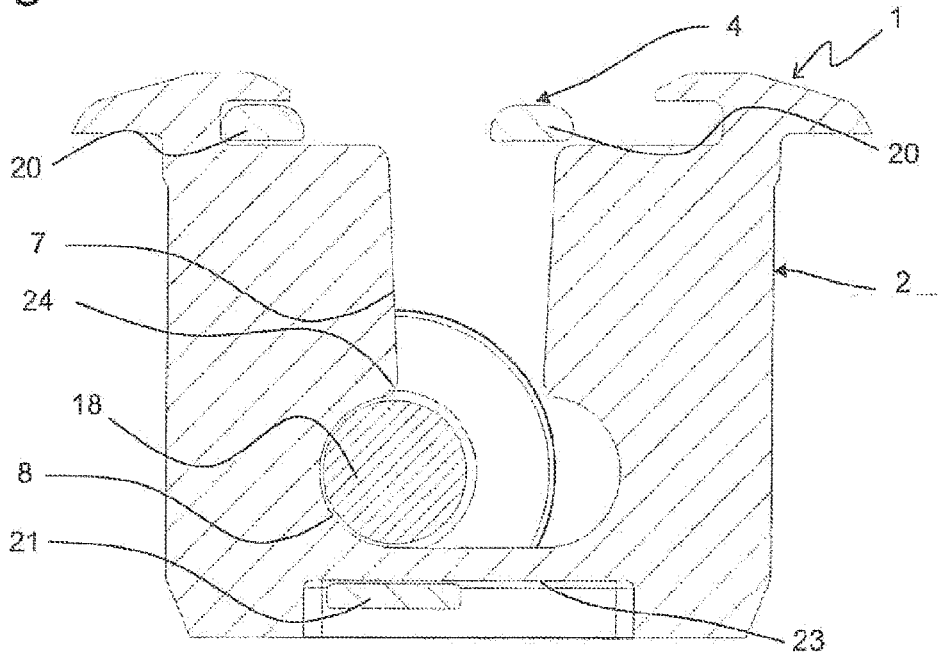
FIG. 9 shows a longitudinal section through the shelf carrier and the mounting bolt in accordance with IX-IX of FIG. 8.

FIGS. 8 and 9 show the shelf carrier 1 with inserted mounting bolt 15, wherein the slider 4 and therefore also the mounting bolt 15 are transversely shifted into the left-hand end position. The edge 24 of the insertion pot 2 secures the mounting bolt 15 in the circular opening 11 in a direction opposite to its insertion direction. As is further illustrated in FIG. 9, the end position of the slider 4 is defined by the lateral abutment of the upper guiding projection 20 on the insertion pot 2.

Figure 10:
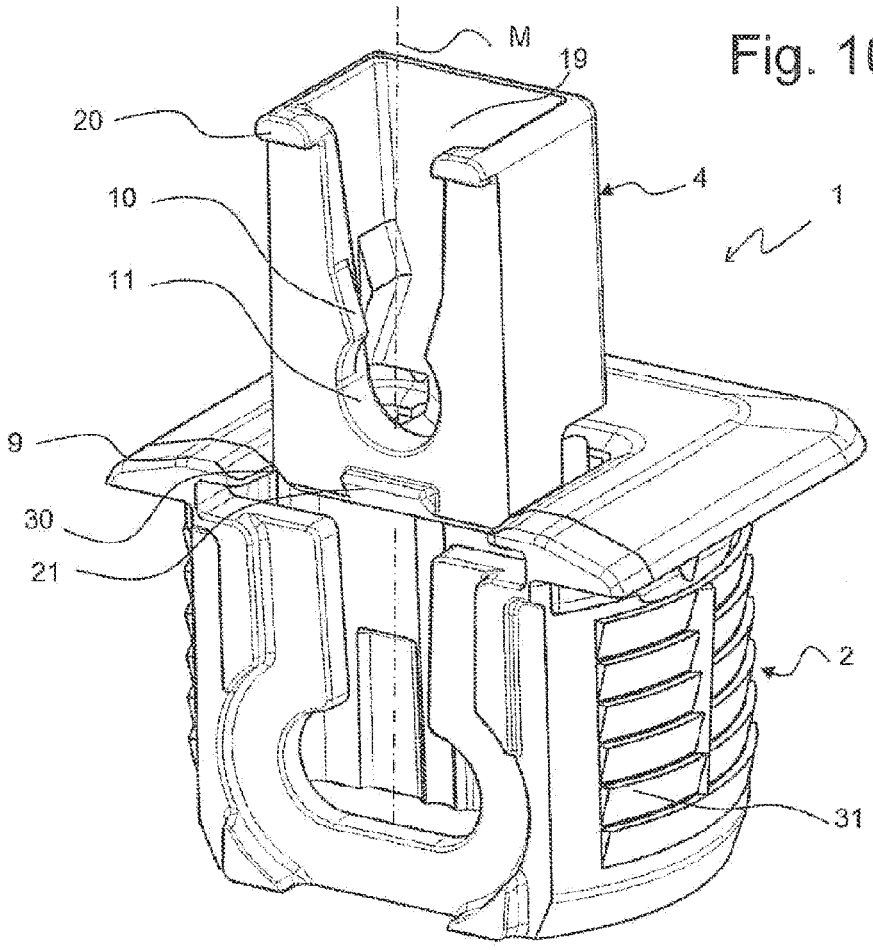
FIG. 10 shows a perspective view analogous to FIG. 1 of the inventive shelf carrier, the insertion pot and the slider of which are produced in one piece connected via predetermined breaking points.
Figure 11:
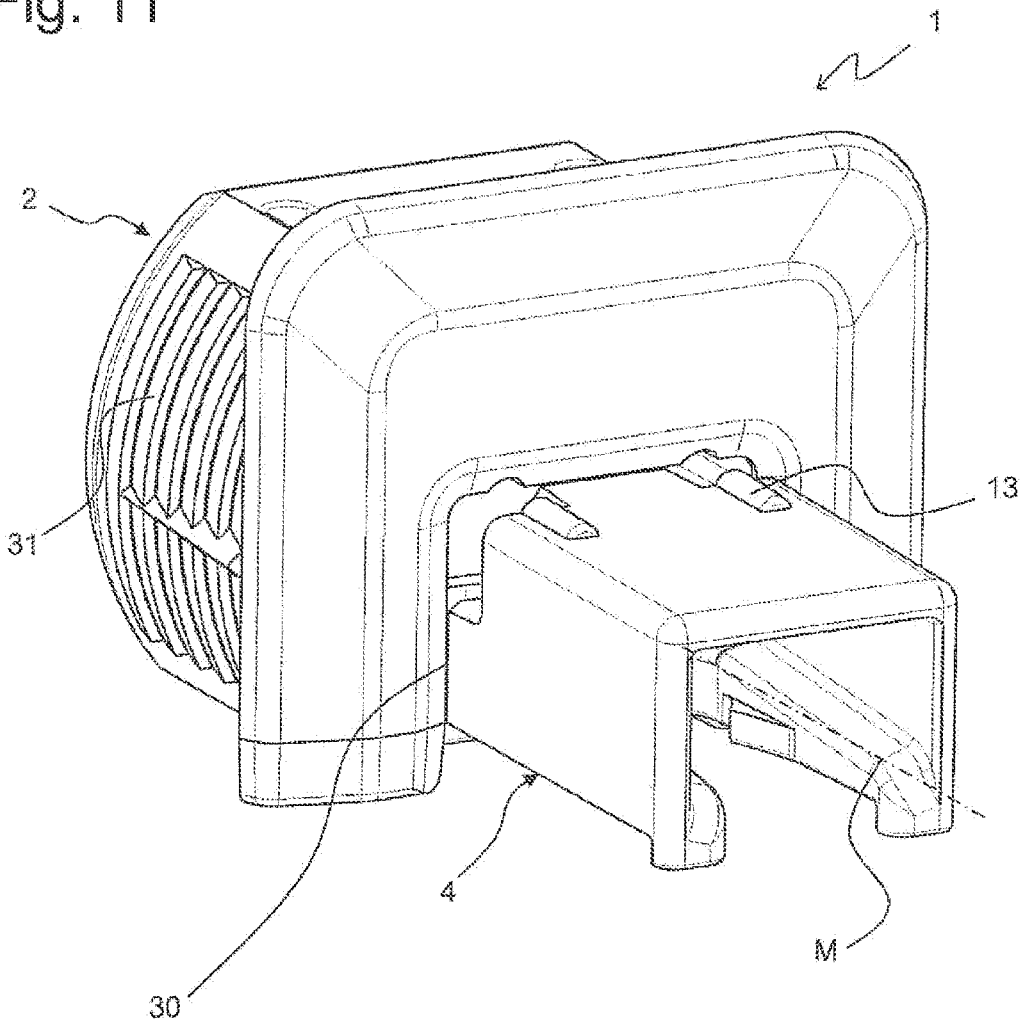
FIG. 11 shows a further perspective view of the shelf carrier of FIG. 10.

FIGS. 10 and 11 show the shelf carrier 1 in the manufacturing state, in which the insertion pot 2 and the slider 4 are initially produced in one piece via predetermined breaking points 30. In this state, the slider 4 is outside of the insertion pot 2 and exactly above the pot opening 3 of the Insertion pot 2. The predetermined breaking points 30 are designed as connecting webs between the bottom side of the slider 4 and the circumferential edge 9 of the insertion pot 2. For inserting the slider 4 into the insertion pot 2, the slider 4 is pressed towards the center axis M into the insertion pot 2 and into the position illustrated in FIG. 1, thereby simultaneously destroying the predetermined breaking points 30.

In order to improve the grip of the shelf carrier 1 within a recess of the shelf (not shown), ribs 31 are formed on the circumferential surface of the insertion pot 2, as shown in FIGS. 1, 6, 10 and 11, which are pressed into the bore wall of the shelves like retaining barbs when the shelves are made from wood. Alternatively or additionally, the insertion pot 2 can comprise detent springs (not shown) which project in a radial outward direction, e.g. in the area of the pot bottom, and are locked on an edge of the shelf when the shelf is made from sheet metal.

FIG. 12*a* shows a shelf 40 comprising four shelf carriers 1 in a state ready for suspension to be suspended on four mounting bolts 15 and FIG. 12*b* shows it in the suspended state, wherein the side views of FIGS. 12*a* and 12*b* only show two shelf carriers 1 and two mounting bolts 15. The mounting bolts 15 are screwed into a side wall of a bookcase (not shown) at a predetermined separation, with their shafts 18 and heads 17 protruding. In the state ready for suspension (FIG. 12*a*), each slider 4 of the shelf carriers 1 is in center position.

As is illustrated in FIG. 12*a*, the shelf 40 is lowered with its rear, in the present case, left-hand end that is inclined in a downward direction, and is suspended with its rear, in the present case, left-hand shelf carrier 1 in the left-hand mounting bolt 15 until the latter is locked in the circular opening 11 of the slider 4 (FIGS. 3 to 5). The still inclined shelf 40 is then shifted to the rear, i.e. to the left-hand side, and the slider 4 of the left-hand shelf carrier 1 is thereby transversely shifted at the stationary left-hand mounting bolt 15 into its right-hand end position illustrated in FIG. 12*b*. The left-hand shelf carrier 1 is locked on the left-hand mounting bolt 15 in a direction opposite to the suspension direction in the right-hand end position of the slider 4 illustrated in FIGS. 8 and 9. The left-hand mounting bolt 15 forms the axis of rotation about which the right-hand end of the shelf 40 is then pivoted downwards until the right-hand shelf carrier 1 is suspended in the right-hand mounting bolt 15 and the latter is locked in the circular opening 11 of the slider 4 (FIGS. 3 to 5).

When a load 41 acts on the free right-hand or front end of the shelf 40 in the suspended state of the shelf 40, as indicated in FIG. 12*b*, the left hand shelf carrier 1 that is locked on the left-hand mounting bolt 15 by means of the slider 4 prevents the shelf 40 from being lifted off from the left-hand or rear mounting bolt 15 and thereby from tilting.

The invention claimed is:

1. A shelf carrier, comprising: an insertion pot, having a side wall with a T-shaped suspension opening, the T-shaped suspension opening being formed by a longitudinal slit extending parallel to a pot axis and by a transverse slit extending perpendicularly thereto, the longitudinal slit being open at an end thereof the open end facing away from the transverse slit; and a slider supported in the insertion pot so as to be displaceable transversely to the longitudinal slit, the slider having a longitudinal slit that extends parallel to the longitudinal slit of the insertion pot and is open at an end facing away from the transverse slit of the insertion pot, and wherein the longitudinal slit forms in a center position of the wall of the slider a common insertion slit together with the longitudinal slit of the insertion pot, the slider being lockable with the insertion pot in the center position and/or in end position transversely shifted to both sides of the center position; and wherein the insertion pot and the slider have detents and locking seats for mutual locking in the center position and/or in the transversely shifted end positions.

2. The shelf carrier according to claim 1, wherein the longitudinal slit of the slider terminates in a circular opening at a level of the transverse slit of the insertion pot.

3. The shelf carrier according to claim 2, wherein the longitudinal slit of the slider has one detent on each side at a transition to the circular opening.

4. The shelf carrier according to claim 1, wherein the longitudinal slit of the slider tapers from the open end towards an opposite end of the slider.

5. The shelf carrier according to claim 1, wherein the longitudinal slits have substantially identical widths.

6. The shelf carrier according to claim 1, wherein the slider has an aperture at the open end of its longitudinal slit.

7. The carrier according to claim 1, wherein the insertion pot has a circumferential surface with circumferential ribs.

8. The carrier according to claim 1, wherein the insertion pot has detent springs that project in a radial outward direction.

9. The carrier according to claim 1, wherein the slider is undetachably retained in the insertion pot.

10. The carrier according to claim 1, wherein the insertion pot and the slider are produced in one work step so as to be connected via at least one predetermined breaking point.

11. The carrier according to claim 1, wherein the insertion pot and the slider are produced from injection-molding plastic.

12. An arrangement, comprising a shelf having one shelf carrier on each side of two shelf ends according to claim 1; and four mounting bolts, wherein the shelf is suspended at four shelf carriers, wherein the sliders of the shelf carriers provided at one shelf end are located in the center position, and the sliders of the shelf carriers provided at the other shelf end are, in end positions thereof, transversely shifted towards the other shelf carriers, in which end position each shelf carrier is locked on one of the mounting bolts in a direction opposite to an insertion direction.

* * * * *